US006146218A

United States Patent [19]

White

[11] Patent Number: 6,146,218

[45] Date of Patent: Nov. 14, 2000

[54] UNIVERSAL PLATFORM FOR HUMAN POWERED FLOATATION DEVICES

[76] Inventor: Robert D. White, P.O. Box 334, Newton, Ill. 62448

[21] Appl. No.: 09/149,397

[22] Filed: Sep. 8, 1998

[51] Int. Cl.[7] ..... B63H 16/20

[52] U.S. Cl. ..... 440/30; 114/61.15

[58] Field of Search ..... 114/61.15, 352–354; 440/21, 26–31

[56] References Cited

U.S. PATENT DOCUMENTS

| | | | |
|---|---|---|---|
| 1,034,278 | 7/1912 | Munsen . | |
| 2,296,147 | 9/1942 | Cremer . | |
| 2,536,152 | 1/1951 | Bass . | |
| 3,045,263 | 7/1962 | Blachly . | |
| 3,352,276 | 11/1967 | Zimmerman . | |
| 3,570,436 | 3/1971 | LeVasseur . | |
| 3,709,185 | 1/1973 | Hennel . | |
| 3,752,111 | 8/1973 | Meynier, Jr. . | |
| 3,826,216 | 7/1974 | Rhody . | |
| 3,982,495 | 9/1976 | Hill . | |
| 4,023,222 | 5/1977 | Selby . | |
| 4,023,795 | 5/1977 | Pauls . | |
| 4,092,945 | 6/1978 | Ankert . | |
| 4,170,188 | 10/1979 | Jamison . | |
| 4,285,674 | 8/1981 | Chew . | |
| 4,406,239 | 9/1983 | Enzmann . | |
| 4,427,392 | 1/1984 | Schneider . | |
| 4,754,998 | 7/1988 | LeJuerrne . | |
| 4,836,298 | 6/1989 | Laboureau | 114/352 |
| 5,011,441 | 4/1991 | Foley . | |
| 5,224,886 | 7/1993 | Cunningham . | |
| 5,377,886 | 1/1995 | Sickler . | |
| 5,387,140 | 2/1995 | Cunningham . | |
| 5,547,406 | 8/1996 | White . | |
| 5,651,706 | 7/1997 | Kasper | 114/354 |
| 5,702,274 | 12/1997 | White . | |

*Primary Examiner*—Ed L. Swinehart

*Attorney, Agent, or Firm*—Streets & Steele; Jeffrey L. Streets

[57] ABSTRACT

A universal platform for a human powered floatation device. The platform has a frame with two spaced apart rail members adapted to interchangeably receive multiple types of propulsion devices. A support arm and a crossbar are provided for securing a propeller drive assembly, seats and pedals to the rails of the frame while allowing longitudinal position adjustment along the frame and an interchange of propulsion devices, such as a bicycle or ski machine.

17 Claims, 7 Drawing Sheets

UNIVERSAL PLATFORM FOR HUMAN POWERED FLOATATION DEVICES

BACKGROUND OF THE INVENTION

1. Field of the Invention

The present invention relates to human powered water craft. More particularly, the invention relates to a water craft having a universal platform that can be powered by a variety of human powered devices, such as a bicycle.

2. Background of the Related Art

The development of individual pedal powered flotation devices began at least as early as 1967, when Zimmerman (U.S. Pat. No. 3,352,276) disclosed a pontoon boat having a seat, pedals and handlebars, each uniquely designed for use on the boat, attached in a configuration similar to a bicycle. However, the seat, pedals and handlebars were dedicated for use with the pontoon boat and could not be used with a functioning bicycle.

Hennel (U.S. Pat. No. 3,709,185) discloses an amphibious motor bike capable of operating on land and carrying the necessary equipment for traveling over water. Before traveling over water, sectionalized pontoons are taken from the side carriers to be assembled and inflated. A water paddle is mounted onto the rear wheel to be rotated thereby and thus propel the motor bike over the water. Steering is controlled by the front handlebars after a rudder swings downward into place below the front wheel. However, this water going vessel is not very maneuverable.

Hill (U.S. Pat. No. 3,982,495) discloses a bicycle powered boat having an integrated, hydrodynamically shaped hull comprising forward and rear hull sections uniquely designed to be secured to and driven by a conventional bicycle. Both hull sections could be mounted on and carried on a rear bicycle carrier or be removed from the bicycle entirely. This device uses a rudder on the forward hull to steer. The vessel is powered by a propeller coupled to a friction roller engaging the rear bicycle wheel. However, reliance on friction for transmission of power to the propeller is less than desirable, especially when the wheel and roller will invariably get wet.

Ankert et al. (U.S. Pat. No. 4,092,945) discloses a float for attachment to the frame and axles of a standard bicycle. The bicycle pedals are provided with paddle means and the front wheel is provide with a rudder. However, the paddles provide very low power and efficiency of effort.

Chew (U.S. Pat. No. 4,285,674) discloses a float for a standard bicycle, similar to Ankert et al. above, except that the front wheel is provided with a solid circular disc to act as a rudder and the spokes of the back wheel have impeller cups or vanes attached thereto. However, this arrangement is also low in power and efficiency.

Schneider (U.S. Pat. No. 4,427,392) discloses an outboard propeller drive and steering assembly for a boat. The pedal driven system utilizes a plurality of gears, sprockets, and universal joints to provide a propeller that is steerable with a single rotating hand grip. However, the system is dedicated to use with a specially designed boat and the gear ratio is fixed.

Cunningham (U.S. Pat. No. 5,224,886) discloses a pontoon with a tubular structure to support a standard bicycle. The front wheel is removed and the front fork is attached to a support that is connected to a front rudder. The rear wheel of the bicycles rests on a rotating drum to transfer power to the drive propeller. However, the device still suffers from many of the problems mentioned above.

Cunningham (U.S. Pat. No. 5,387,140) discloses a pontoon with a tubular structure to support a standard bicycle having a combined propeller/rudder unit. The rear wheels of the bicycle rest on a rotating drum to transfer power through a flexible drive shaft to the drive propeller. The front fork is connected with an elaborate directional control system that operates to turn the apparatus in the direction of the handle bars.

Despite the above attempts to provide human powered flotation device, there remains a need for an improved device that is universally adapted to several different types of devices, is lightweight, and is easy to assemble.

It would be desirable if the device would allow for the use of equipment already owned by the operator or that the device be adjustable so that user's of any size can adjust the device to fit them personally. It would also be useful if the equipment could be quickly and easily mounted and dismounted from the device.

SUMMARY OF THE INVENTION

The present invention provides a universal platform for human powered flotation devices. The platform has a frame having a longitudinal axis, a first end and a second end, and two rail members positioned in a spaced apart relationship. There is at least one transverse member adjustably attached to the frame, having opposing ends extending away from the longitudinal axis of the frame. A first and second floatation member attached to one of the opposing ends of the transverse member. There is at least one adjustable attachment means comprising a support arm and a crossbar, wherein the crossbar defines a channel that is closely received by the frame and the support arm has a first end that is closely received between the rail members of the frame. The crossbar is removably attached to the first end of the support arm. A propeller drive assembly is attached to the second end of the support arm of the attachment means. A rudder is attached to the frame. A crank mechanism is adjustably mounted on the frame.

Preferably, the first end of the support arm defines an annular shoulder facing the first end that contacts the rail members of the frame when the crossbar is attached to the support arm. The frame preferably has two outer side surfaces connected to two inner side surfaces by a top surface and a bottom surface. The channel defined by the crossbar has two side surfaces connected by a bottom surface. The support arm is in intimate contact with the inner side surfaces of the frame and the side surfaces of the crossbar are in intimate contact with the outer side surfaces of the frame when the support arm is attached to the frame.

Preferably, the frame includes a first male clamp member defining a pair of channels. The rail members of the frame are closely received in the channels and a fastening means extends through one transverse member and into the male clamp member such that the transverse member is adjustably attached to the frame. A second male clamp member is preferably provided to attach the second transverse member to the frame.

The support arm can form a generally perpendicular angle with the longitudinal axis of the frame or it can form an angle with the frame, depending on the type of device being used with the frame.

The propeller drive assembly can have a transverse axle disconnectably connected to the rear mounting brackets; a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle; a rigid arm downwardly depending from the axle having a lower end; a housing attached to the lower end of the rigid arm and having a rearwardly extending axis of rotation; a propeller shaft extending through the housing having a propeller attached to a first end, a first bushing, a second bushing, and a lower drive belt sprocket coupled to a second end; a drive belt frictionally engaging the upper and lower drive belt sprockets; and an idler coupled to the rigid arm in contact with the upper drive belt sprocket. The idler is adapted to adjust the tension on the drive belt. The chain sprocket cluster is freely accessible for engagement with a chain so that pedaling the crank mechanism causes the propeller to move the flotation device.

Preferably, the rigid arm is curvilinear so that the rigid arm is positionable outside the frame when the drive belt is positioned between the rail members of the frame. In addition, the propeller drive assembly is axially adjustable for the purpose of trimming the propeller to the desired height and for moving when it contacts submersed objects. Preferably, the lower drive belt sprocket of the propeller drive assembly is submersible.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are, therefore, not to be considered limiting of its scope, for the invention may admit to other equally effective embodiments.

DETAILED DESCRIPTION OF THE PREFERRED EMBODIMENTS

Figure 1:
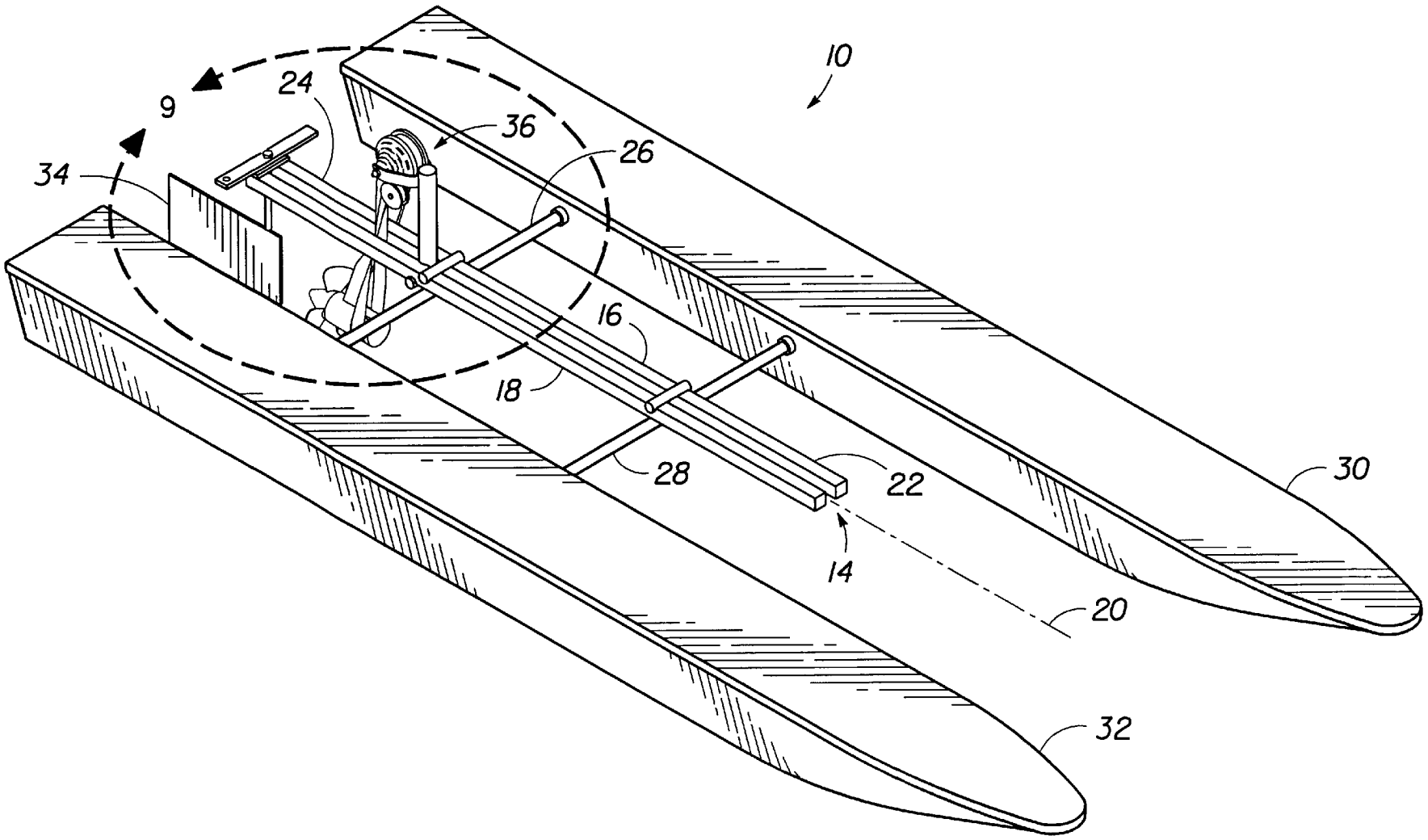
FIG. 1 is a perspective view of the universal platform of the present invention.

The present invention relates to a universal platform for human powered floatation devices. More particularly, the present invention relates to a universal platform that is adjustable and can be adapted for use with a standard bicycle, a skiing machine, a recumbent bicycle, chair seating cycle or the like.

One aspect of the invention provides a universal platform having a frame with two rail members positioned in a spaced relationship parallel to one another. The rail members can be made from aluminum, stainless steel or like materials that are light weight and durable. There are typically two or more transverse members attached to the frame for holding floatation members such as pontoons. The transverse members are preferably round rods made of aluminum, plastic, stainless steel or similar material. The transverse members are preferably substantially perpendicular to the frame and are attached to the frame using a male clamp member.

The male clamp member defines a pair of channels, where each channel is sized to receive one of the rail members. A bolt or other fastening means can be used to fasten the male clamp member to the transverse member with the frame positioned in the channel. The channel provides multiple points of contact between the male clamp member and the frame, thus ensuring a stable attachment. The transverse members are adapted so that a pair of pontoons may be removably attached thereto. The pontoons are preferably made from lightweight fiberglass material or other lightweight molding material so that they may be positioned and removed from the frame with ease.

At least one adjustable attachment means is attached to the frame for mounting various components of the human powered floatation device to the frame. The adjustable attachment means has a support arm and a crossbar. The crossbar defines a channel that is closely received by the frame. The support arm has a first end that is closely received between the rail members of the frame and is attached to the crossbar. This configuration allows one to adjust the position of the support arm longitudinally on the frame while providing a secure mounting means that resists side-to-side or back-and-forth movement when secured to the frame. This type of attachment means is useful for attaching most components to the frame, including seats and mounting brackets for various chain drive mechanisms and the propeller drive assembly.

A propeller drive assembly is attached to the second end of the support arm of the attachment means. In addition, the propeller drive assembly is attached to a crank mechanism adjustably mounted on the frame. The crank mechanism is used typically with pedals to impart a rotational force on the propeller drive assembly, which is then translated to the propeller to move the floatation device. The crank mechanism can be a chain sprocket assembly such as a standard bicycle sprocket, a stand-alone pedal system with a chain sprocket assembly, or a flywheel such as that used on a ski machine.

A rudder is fixed to the rail members near the second end of the frame. Preferably, the rudder is attached to a steering member which can be connected to the frame in a number of ways depending on the type of device being used with the frame.

Regardless of what type of crank mechanism used to generate rotational force, a bracket is positioned near the first end of the frame for holding either the front end of a bicycle or the crank mechanism. The bracket is mounted on a second adjustable attachment means similar to that described above. The bracket is therefore adjustable longitudinally with respect to the frame and can be adjusted to fit the particular device desired. The bracket for use with a bicycle can be of the forked type like that described in U.S. Pat. No. 5,547,406 to White, which disclosure is incorporated by reference herein. If a ski machine is being used with the universal platform, the bracket may be of the type described in U.S. Pat. No. 5,702,274 to White, which disclosure is incorporated by reference herein.

More specifically, it is preferred that the first end of the support arm defines an annular shoulder facing the first end. The shoulder contacts the rail members of the frame when the crossbar is attached to the support arm. Thus, the frame has two outer side surfaces, connected to two inner side surfaces by a top surface and a bottom surface. The channel defined by the crossbar has two side surfaces connected by a bottom surface. The support arm is in intimate contact with the inner side surfaces of the frame and the bottom surface of the crossbar, and the side surfaces of the crossbar are in intimate contact with the outer side surfaces of the frame when the support arm is securely engaged with the frame. Therefore, when the attachment means is in place, the support arm has multiple points of contact, thus resisting any axial, lateral or other type of movement. This type of adjustable attachment means is useful, because it is simple in design yet provides a stable load bearing support that can be adjusted in position to suit the needs of the user. The support arm can be made from stainless steel, aluminum or other high strength, rigid material.

The propeller drive assembly used in the present invention includes a transverse axle disconnectably connected to a pair rear mounting brackets mounted on the frame. The rear mounting brackets are mounted to the frame using an attachment means as described above where the bracket is attached to the second end of the support arm. A drive gear assembly is mounted concentrically about the axle and has a chain sprocket rigidly coupled to an upper drive belt sprocket and first and second bearings fixed at opposite ends of the assembly which engage with the axle to allow the assembly to spin freely about the axle. A rigid arm downwardly depends from the axle having a lower end. A lower bearing is attached to the lower end of the rigid arm, where the lower bearing has a rearwardly extending axis of rotation that is generally normal to the upper drive belt sprocket axis of rotation. A propeller shaft extends through the lower bearing with a propeller attached to a first end and a lower drive belt sprocket coupled to a second end. A drive belt engages the upper and lower drive belt sprockets such that the drive belt passes over the idler. The drive belt is a standard timing belt with grooves. An idler is coupled to the rigid arm adjacent the upper drive belt sprocket. The idler is adapted to align the drive belt so that it passes through the rails without touching the rails. The idler may also be used to maintain tension on the belt. The chain sprocket cluster is freely accessible for engagement with a bicycle chain or other chain so that pedaling the bicycle causes the propeller to push the flotation device forward.

The rigid arm provides a point of attachment for the drive gear assembly, the idler, and the propeller. The arm is bent such that the assembly can be mounted on the frame and the drive gear assembly is maintained essentially in a straight line with the propeller. The bend in the arm allows the drive belt to pass between the frame, while the arm resides outside the frame. The use of a rigid arm eliminates the need for a housing and is fully submersible in water.

A male clamp member may be provided forward of the propeller drive assembly, for trimming the propeller. The rigid arm rests on the male clamp member, so that the male clamp member can be moved toward the forward or rear of the floatation device until the proper propeller angle is achieved.

The crank mechanism can be a chain sprocket with pedals connected to the propeller drive assembly such that the propeller drive assembly receives rotational forces from the crank mechanism. These rotational forces are translated to a propeller and ultimately drive the floatation device forward. The crank mechanism can be adapted to make the device move in a rearward direction.

A sprocket, a pair of foot pedals, and a gear-changing derailleur may be coupled to the sprocket assembly. A bicycle chain connects the sprocket to the propeller drive assembly.

FIG. 1 is a perspective view of the universal platform 10 of the present invention. The platform 10 has a frame 14 which consists of two rail members 16, 18, and a longitudinal axis represented by line 20, a first end 22 and a second end 24. The platform also has a pair of transverse members 26, 28 that are adapted to receive a pair of pontoons 30, 32. The second end of the frame 14 supports a rudder 34 that is used for steering the platform 10 and a propeller drive assembly 36 that drives the platform 10.

Figure 2:
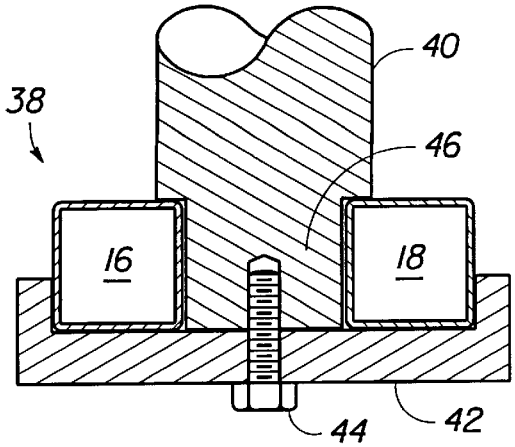
FIG. 2 is a cross-sectional view of the support arm of the present invention.

FIG. 2 is a cross-sectional view of the adjustable attachment means 38 of the present invention. The attachment means 38 has a support arm 40, a cross bar 42, and a bolt 44. The support arm 40 has a first end 46 that is closely received between the rail members 16 and 18. The crossbar 42 defines a channel 43 (See FIG. 3) that is closely received by the frame 14. The support arm 40 is preferably attached to the crossbar 42 with a bolt so that the support arm can easily be moved along the longitudinal axis of the frame 14. The first end 46 of the support arm 40 defines an annular shoulder 48 facing the first end 46 that contacts the rail members 16, 18 of the frame 14 when the crossbar 42 is attached to the support arm 40.

Figure 3:
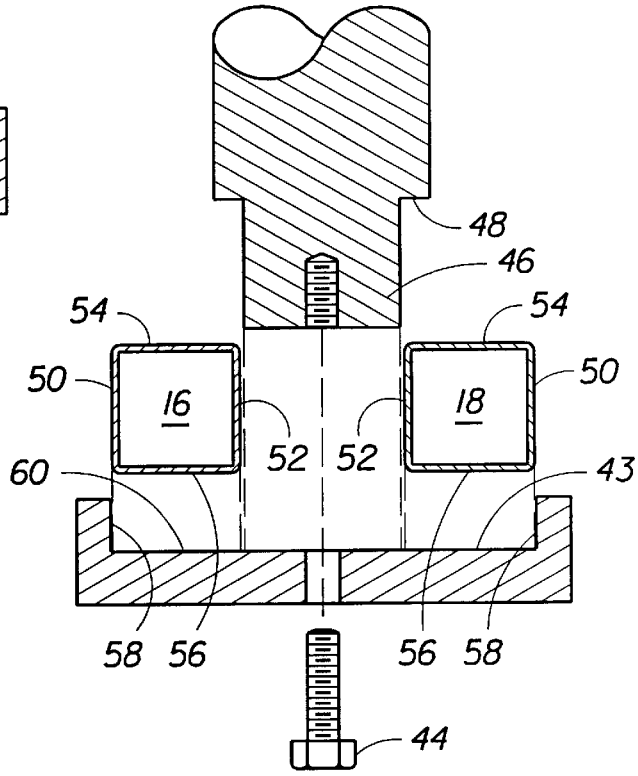
FIG. 3 is an exploded view of the support arm attached to the frame.

FIG. 3 is an exploded view of the support arm attached to the frame 14. The frame 14 has two outer side surfaces 50 connected to two inner side surfaces 52 by a top surface 54 and a bottom surface 56, and the channel 43 defined by the crossbar 42 has two side surfaces 58 connected by a bottom surface 60, wherein the support arm 40 is in intimate contact with the inner side surfaces 52 of the frame 14 and the bottom surface 60 of the crossbar. The side surfaces 58 of the crossbar are in intimate contact with the outer side surfaces 50 of the frame 14.

Figure 4:
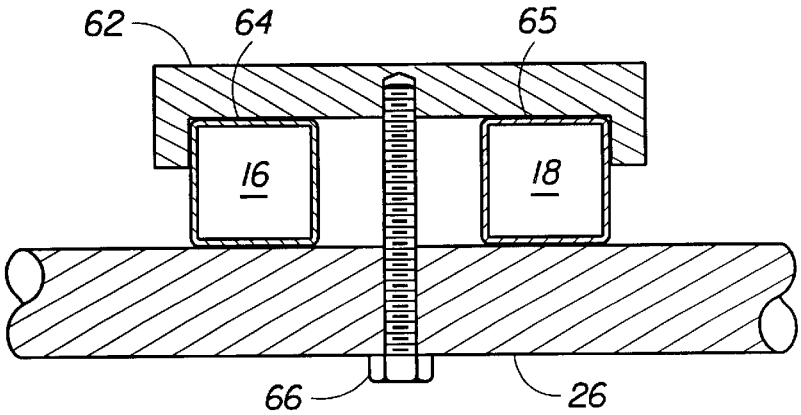
FIG. 4 is a cross-sectional view of a frame attached to the transverse member.

FIG. 4 is a cross-sectional view of a transverse member 26 attached to the frame 14. A male clamp member 62 defining a first channel 64 and a second channel 65 closely receives rail members 16 and 18 of the frame 14. A fastening means or bolt 66 extends through a transverse member 26 and into male clamp member 62 such that the frame 14 is adjustably attached to transverse member 26.

Figure 5:
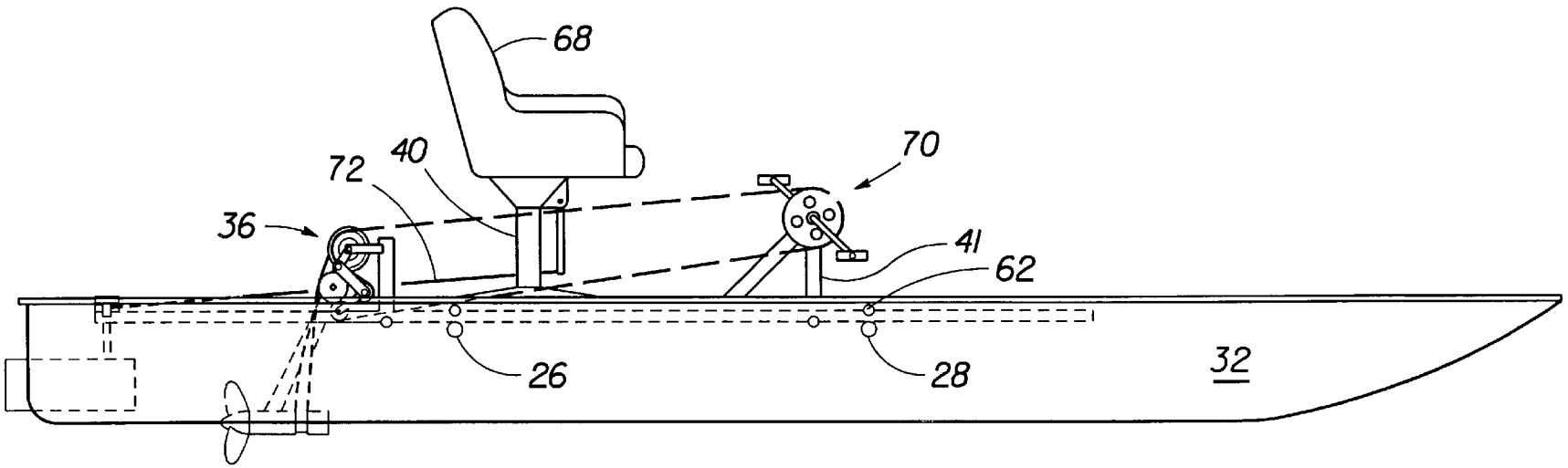
FIG. 5 side view of one embodiment of the present invention.

FIG. 5 is a schematic view of the universal platform shown with a seat 68 and a pedal and sprocket assembly 70. A chain connects the pedal and sprocket assembly 70 to the propeller drive assembly 36. A steering line 72 is connected between the rudder and a steering handle (not shown) attached to the seat 68. The seat is attached to the universal platform 10 with a second attachment means 40, thus the seat can be moved forward or back to suit the needs of the user. In addition, the pedal and sprocket assembly 70 is attached to the platform with an attachment means 41, so that it may be adjusted longitudinally.

Figure 6:
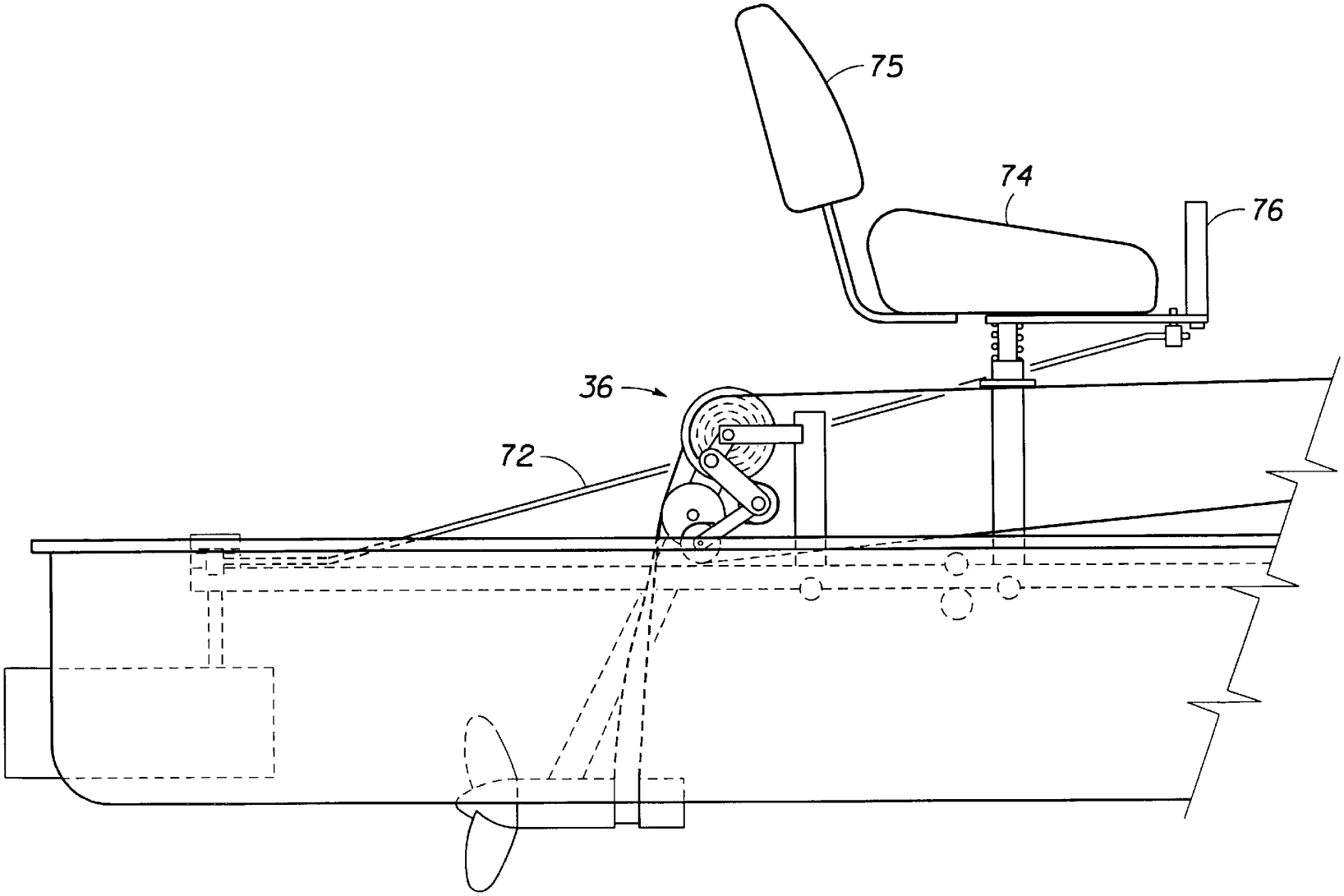
FIG. 6 is a schematic view of the propeller drive assembly in one embodiment of the present invention.

FIG. 6 is a schematic view of the second end of the universal platform, showing a seat 74 that may be used with a reclining back portion 75 to form a recumbent seating cycle. A standard pedal and sprocket assembly like the one shown in FIG. 5 can be used with the seat 74. A steering line 72 is provided between the rudder and a steering handle 76 adjacent to the seat 74. The propeller drive assembly 36 has a standard bicycle sprocket and can be fitted with a standard bicycle chain and derailleur.

Figure 7:
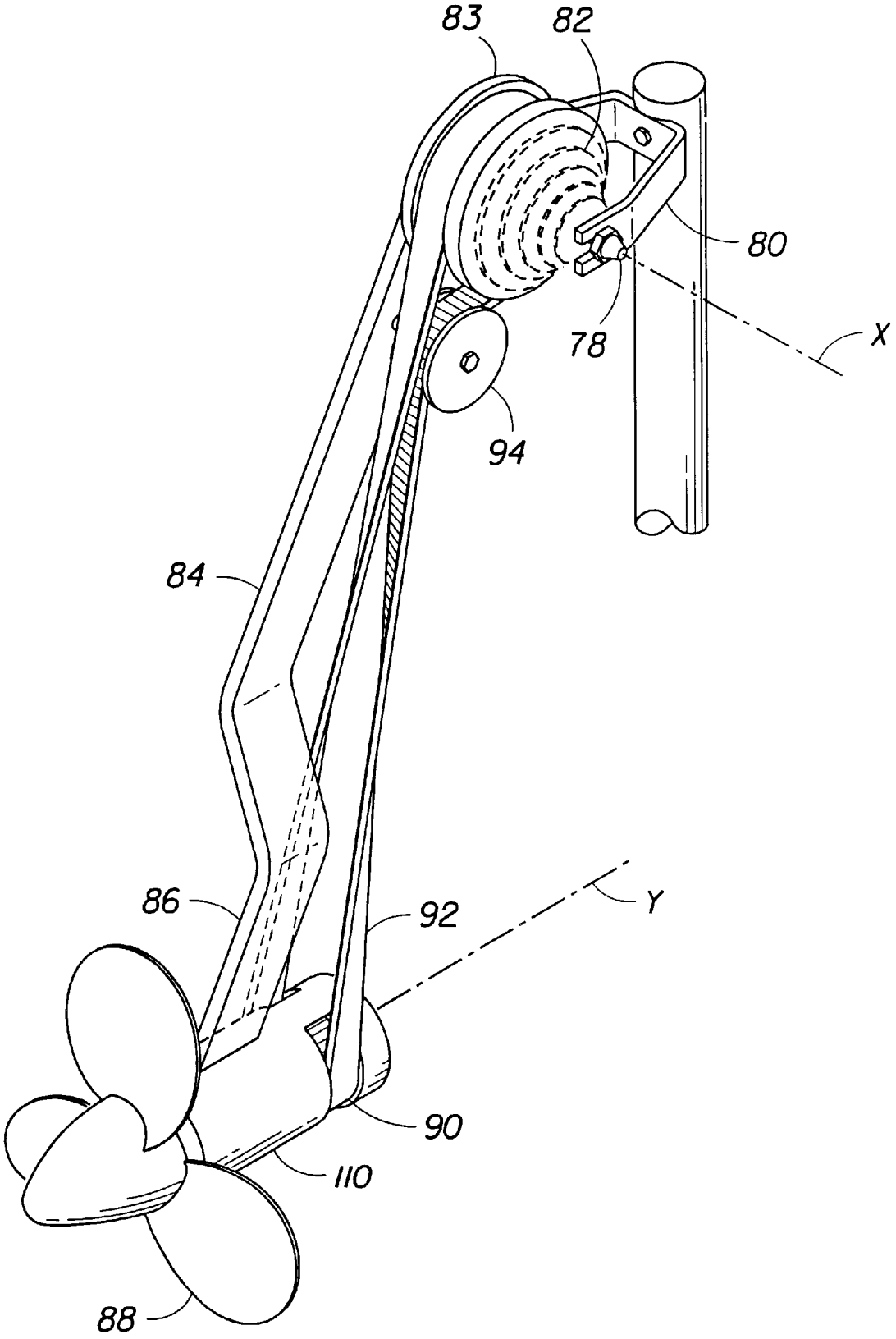
FIG. 7 is a schematic view of the propeller drive assembly of the present invention.

FIG. 7 is a schematic view of the propeller drive assembly 36. The assembly has a transverse axle 78, similar to a standard bicycle axle, disconnectably connected to the rear mounting brackets 80. A drive gear assembly 82 is mounted concentrically about the axle comprising a chain sprocket rigidly coupled to an upper drive belt sprocket 83 and first and second bearings fixed at opposite ends of the assembly and engaging the axle to allow the assembly to spin freely about the axle as shown in U.S. Pat. 5,547,406. A rigid arm 84 downwardly depends from the axle 78 having a lower end 86. A housing 110 supporting a lower bearing (or a flanged bushing) 112 (shown in FIG. 8) is attached to the lower end 86 of the rigid arm 84. The lower bearing has a rearwardly extending axis of rotation along the axis labeled y.

Figure 8:
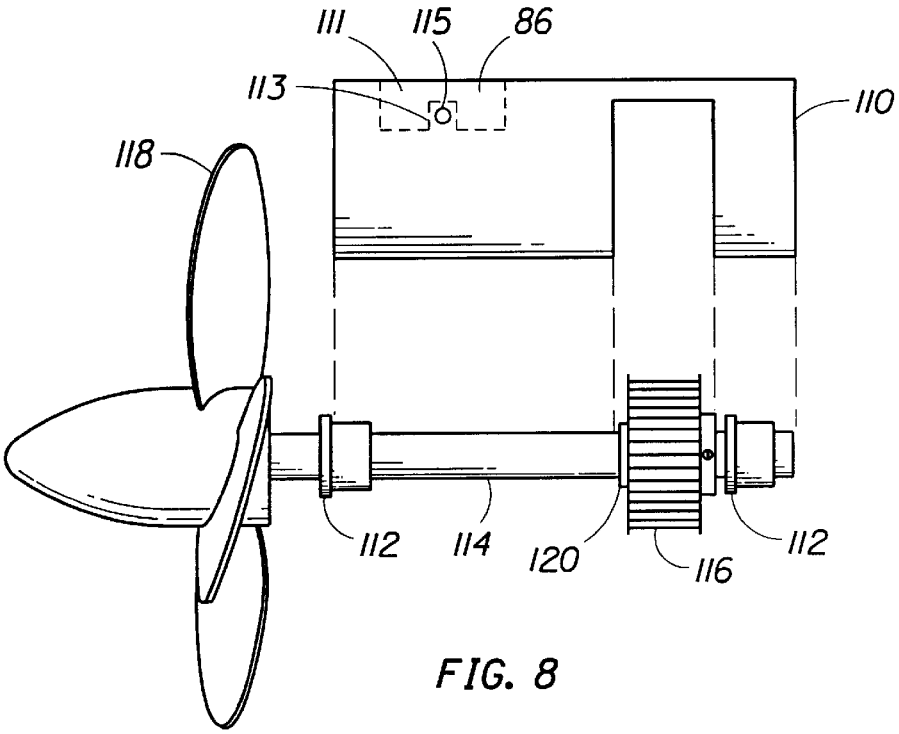
FIG. 8 is an exploded view of the housing shown in FIG. 7.

FIG. 8 is an exploded view of the housing 110 shown in FIG. 7. The lower bearing 112 has a propeller shaft 114 extending therethrough with a lower drive belt sprocket 116 fixed to one end and a propeller 118 fixed to the opposite end. The lower bearing 112 comprises a pair of flanged bushings that are pressed into the housing 110. A nylon washer 120 is also provided to reduce potential friction between the housing and the lower drive belt sprocket. The upper and lower drive belt sprockets 83, 116 are provided with grooves that complement the grooves on the drive belt so that the drive belt securely engages the upper and lower drive belt sprockets. The lower end of the rigid arm is sized to be received by a slot 111 formed in the housing. The rigid arm also defines a slot 113 that is secured to the housing with a bolt 115. The housing has a threaded bolt hole (not shown) for threading a standard bolt into the slot so that the length and therefore the tension on the drive belt may be adjusted to suit the users needs.

Referring back to FIG. 7, an idler 94 is coupled to the rigid arm 84 in contact with the upper drive belt sprocket 83. The idler 94 is positioned to maintain tension on the drive belt and keep the drive belt from touching itself while the propeller drive assembly is in motion. This is necessary, because the upper drive belt sprocket 83 rotates about the axis labeled x which is generally normal to the y-axis about which the propeller 118 rotates so the belt is twisted to translate the motion from the upper drive belt sprocket 83 the lower drive belt sprocket 116. The chain sprocket cluster 82 is freely accessible for engagement with a chain that can be associated with a crank mechanism such as a pedal and sprocket assembly or that of a standard bicycle.

Figure 9:
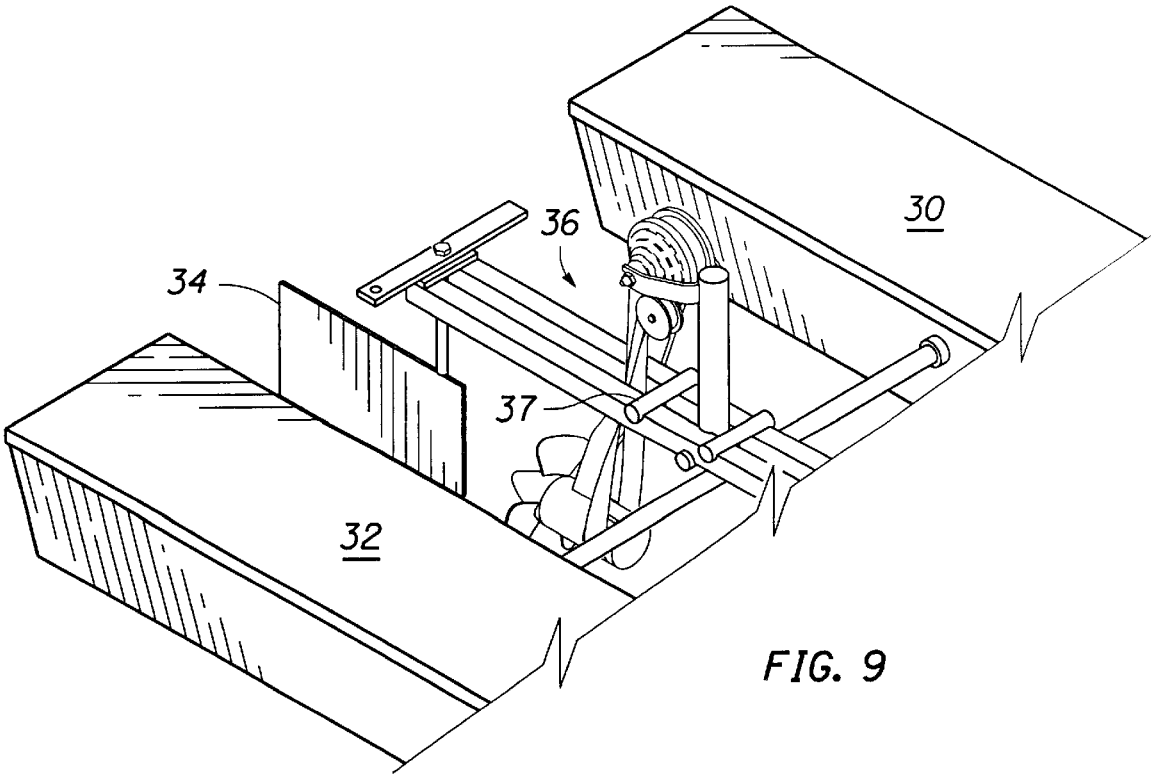
FIG. 9 is an enlarged view of the propeller drive assembly shown in FIG. 1.

FIG. 9 is an enlarged view of the propeller drive assembly 36 shown in FIG. 1. The frame 14 has a second crossbar 37 attached to the top surface. The second male clamp member 37 is adjustable longitudinally about the frame to aid in trimming the propeller, such that the rigid arm 84 of the propeller drive assembly can rest against the second male clamp member 37. Since the drive gear assembly is freely rotatable about the axle, the male clamp member 37 also eliminates the need for any type of housing to maintain the propeller drive assembly in a given position. The propeller drive assembly will also easily rotate upwardly when the propeller contacts submerged objects, protecting the propeller drive assembly from damage.

Figure 10:
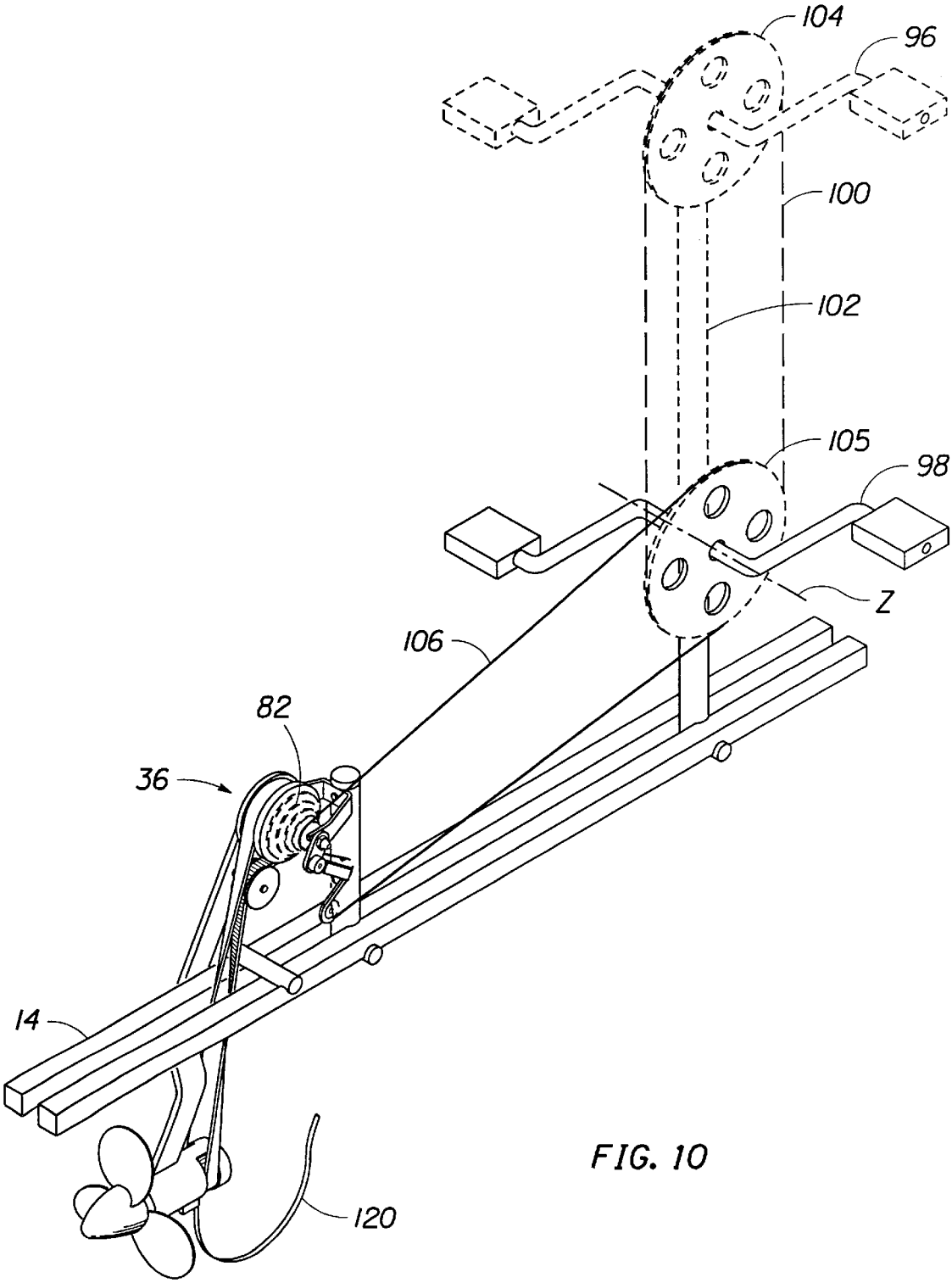
FIG. 10 is a schematic view of an additional embodiment of the present invention.

FIG. 10 is a schematic view of an additional embodiment of the present invention. The present personal powered floatation device can be powered using either hand or foot pedals and can be operated for paraplegic use without further adaptation. The frame 14 has hand levers 96 and foot pedals 98, a propeller drive assembly 36. A steering mechanism engaging a rudder assembly coupled to the frame 14 and a seat (not shown), as described above may be coupled to the water flotation device. The hand levers 96 and foot pedals 98 can be positioned eccentrically one to another to round out the circular motion of the device. Thus, the floatation device can be propelled using either arms or legs and is paraplegic ready. A first bicycle chain 106 connects sprocket 105 to the propeller drive assembly 36, and an upright frame member 102 connects a hand-rotatable sprocket head 104 to the frame 14. A pair of hand levers 96 are attached to the hand-rotatable sprocket head 104. A second bicycle chain 100 connects a second sprocket to the foot-actuated sprocket body 105. The sprocket body 105 has two sets of gears, one coupled to chain 106 and the other coupled to chain 100. This allows the hand levers and upright frame member 102 to be rotated as shown by the arrow about axis z without effecting the chain length. When the operator is using the hand levers, the foot pedals will also rotate. An optional securing device can be provided to secure intact but non-functioning limbs to either the hand levers or to the foot pedals.

In addition, the housing 110 has a skeg 120 mounted thereon to protect the propeller from objects under the water that it may encounter.

While the foregoing is directed to the preferred embodiment of the present invention, other and further embodiments of the invention may be devised without departing from the basic scope thereof The scope of the invention is determined by the claims which follow.

I claim:

1. An apparatus comprising:

a frame having a longitudinal axis, a first end and a second end, and two rail members positioned in a spaced apart relationship;

at least two transverse members adjustably attached to the frame, having opposing ends extending away from the longitudinal axis of the frame;

a first floatation member attached to one of the opposing ends of the transverse members;

a second floatation member attached to the other opposing ends of the transverse members;

at least one adjustable attachment means comprising a support arm and a crossbar, wherein the crossbar defines a channel that is closely received by the frame and the support arm has a first end that is closely received between the rail members of the frame, wherein the crossbar is removably attached to the first end of the support arm;

a propeller drive assembly attached to the second end of the support arm of the attachment means;

a rudder attached to the frame; and a crank mechanism adjustably mounted on the frame.

2. The apparatus of claim 1, wherein one or more of the at least one adjustable attachment means is positioned near the first end of the frame and a bracket mounted on the one or more of the at least one adjustable attachment means, wherein the crank mechanism is mounted on the bracket.

3. The apparatus of claim 1, wherein the adjustable attachment means is adjustable along the longitudinal axis of the frame.

4. The apparatus of claim 1, wherein the first end of the support arm defines an annular shoulder facing the first end that contacts the rail members of the frame when the crossbar is attached to the support arm.

5. The apparatus of claim 1, wherein the frame has two rails, each rail having an outer side surface connected to an inner side surface by a top surface and a bottom surface, and the channel defined by the crossbar has two side surfaces connected by a bottom surface, wherein the support arm is in intimate contact with the inner side surfaces of the frame, and the side surfaces of the crossbar are in intimate contact with the outer side surfaces of the frame.

6. The apparatus of claim 1, wherein the crank mechanism comprises a pedal and chain sprocket assembly connected to the propeller drive assembly.

7. The apparatus of claim 1, further comprising a steering member coupled to the rudder, wherein the rudder is attached to the second end of the frame.

8. The apparatus of claim 1, wherein the first and second floatation members are pontoons that provide sufficient buoyancy and stability to support a self propelled device and a human on a surface of a body of water.

9. The apparatus of claim 8, wherein the pontoons are slidably connected to the transverse members of the frame.

10. The apparatus of claim 1, wherein the frame further comprises:

a first male clamp member defining a pair of channels, wherein the rail members of the frame are closely received in the channels and a fastening means extending through one transverse member and into the male clamp member such that the transverse member is adjustably attached to the frame.

11. The apparatus of claim 1, wherein the frame further comprises:

two or more male clamp members, each male clamp member defining a pair of channels, wherein the rail members of the frame are closely received in the channels and a fastening means extending through one transverse member and into the male clamp member such that the transverse member is adjustably attached to the frame.

12. The apparatus of claim 1, wherein the support arm forms a generally perpendicular angle with the longitudinal axis of the frame.

13. The apparatus of claim 1, wherein the support arm is angled toward the first end of the frame.

14. The apparatus of claim 1, wherein the propeller drive assembly further comprises:

a transverse axle disconnectably connected to a rear mounting bracket;

a drive gear assembly mounted concentrically about the axle comprising a chain sprocket cluster rigidly coupled to an upper drive belt sprocket, and first and second bearings fixed at opposite ends of the assembly and engaging the axle to allow the assembly to spin freely about the axle;

a rigid arm downwardly depending from the axle having a lower end;

a lower bearing attached to the lower end of the rigid arm and having a rearwardly extending axis of rotation;

a propeller shaft extending through the lower bearing having a propeller attached to a first end and a lower drive belt sprocket coupled to a second end;

a drive belt frictionally engaging the upper and lower drive belt sprockets; and an idler coupled to the rigid arm wherein the idler is adapted to adjust the tension on the drive belt, wherein the chain sprocket cluster is freely accessible for engagement with a chain so that pedaling the crank mechanism causes the propeller to move the flotation device.

15. The apparatus of claim 14, wherein the rigid arm is curvilinear so that the rigid arm is positionable outside the frame when the drive belt is positioned between the rail members of the frame.

16. The apparatus of claim 1, wherein the propeller drive assembly is axially adjustable for the purpose of trimming the propeller to the desired height.

17. The apparatus of claim 14, wherein the lower drive belt sprocket of the propeller drive assembly is submersible.

* * * * *